US011383952B2

(12) United States Patent
Ruiz et al.

(10) Patent No.: US 11,383,952 B2
(45) Date of Patent: Jul. 12, 2022

(54) SHEET STACKER HAVING MOVABLE ARMS MAINTAINING STACK QUALITY

(71) Applicant: Xerox Corporation, Norwalk, CT (US)

(72) Inventors: Erwin Ruiz, Rochester, NY (US); Bruce A. Thompson, Fairport, NY (US); Derek A. Bryl, Webster, NY (US); Arthur H. Kahn, Wayland, NY (US); Paul F. Brown, II, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 238 days.

(21) Appl. No.: 16/701,505

(22) Filed: Dec. 3, 2019

(65) Prior Publication Data

US 2021/0163243 A1 Jun. 3, 2021

(51) Int. Cl.

| | |
|---|---|
| ***B65H 43/08*** | (2006.01) |
| ***B65H 29/40*** | (2006.01) |
| ***B65H 29/22*** | (2006.01) |

(52) U.S. Cl.

CPC ..... *B65H 43/08* (2013.01); *B65H 29/22* (2013.01); *B65H 29/40* (2013.01); *B65H 2301/4212* (2013.01); *B65H 2301/44765* (2013.01); *B65H 2404/6112* (2013.01); *B65H 2404/63* (2013.01); *B65H 2404/652* (2013.01); *B65H 2553/80* (2013.01)

(58) Field of Classification Search

CPC .... B65H 29/22; B65H 29/40; B65H 2553/80; B65H 2404/652; B65H 2301/4212; B65H 2301/44765

See application file for complete search history.

(56) References Cited

U.S. PATENT DOCUMENTS

| | | | | |
|---|---|---|---|---|
| 4,244,565 | A * | 1/1981 | Geier | B65H 29/40 271/176 |
| 5,040,783 | A * | 8/1991 | Ruehl | B65H 29/68 271/300 |
| 5,145,167 | A | 9/1992 | McGraw et al. | |
| 5,188,353 | A | 2/1993 | Parks | |
| 5,476,256 | A | 12/1995 | Fortuna et al. | |
| 6,131,900 | A | 10/2000 | Hou | |
| 6,623,001 | B2 * | 9/2003 | Steinkogler | B65H 29/40 271/176 |
| 7,017,900 | B2 | 3/2006 | Dobrindt | |
| 8,641,034 | B2 | 2/2014 | Kapturowski et al. | |
| 9,457,980 | B2 | 10/2016 | Kuypers et al. | |

FOREIGN PATENT DOCUMENTS

| | | | |
|---|---|---|---|
| JP | 58212546 A * | 12/1983 | B65H 29/40 |

* cited by examiner

*Primary Examiner* — Patrick Cicchino

(74) *Attorney, Agent, or Firm* — Gibb & Riley, LLC

(57) ABSTRACT

A sheet stacking apparatus includes a frame, a round member directly or indirectly connected to the frame, and an arm directly or indirectly connected to the frame. The arm is rotatable to rotate between a first position and a second position. The arm is positioned to bias sheets toward the round member when in the first position, and the arm is positioned to bias the sheets away from the round member when in the second position.

17 Claims, 8 Drawing Sheets

SHEET STACKER HAVING MOVABLE ARMS MAINTAINING STACK QUALITY

BACKGROUND

Systems and methods herein generally relate to sheet stacking devices and more particularly to sheet stacking devices that maintain stack quality.

Many flexible materials are available in sheet form, including print media, plastic sheeting, metallic sheets, foam materials, etc. It can be more efficient from a processing standpoint to stack these sheets during various stages of processing. In one example, after sheets of print media have received print markings, they are often stacked.

Stacking devices (stackers) are often used to perform such stacking operations. It is useful for such stacking devices to produce stacks in which all sheets lay flat and where the edges of all sheets are aligned. Many times, sheets are inverted just prior to being stacked; however, if the sheets do not fully complete the flipping process involved with inverting the sheets, this can result in sheets being folded under other sheets or in sheets irregularly piling upon one another.

SUMMARY

Various exemplary sheet stacking apparatuses herein include (among other components) a frame and at least one round member (e.g., disk), a first arm, a second arm, and a stacking surface (all directly or indirectly connected to the frame). A first hinge directly or indirectly connects the first arm to the frame and a second hinge directly or indirectly connects the second arm to the frame.

The round member is adapted to rotate, and the round member is positioned relative to the stacking surface to move the sheets toward the stacking surface when rotating. The first arm is rotatable around the first hinge to rotate the first arm between a first position (closed) and a second position (open). The second arm is similarly rotatable around the second hinge to rotate the second arm between a third position (closed) and a fourth position (open).

The second arm is longer than the first arm and extends closer to the stacking surface than the first arm when the first arm is in the first position (closed) and the second arm is in the third position (closed). The round member has leading edge receivers adapted to accept leading edges of the sheets, and the first arm is positioned to direct the leading edges of the sheets into the leading edge receivers of the round member when the first arm is in the first position (closed).

Thus, the first arm is positioned to bias the leading edges of the sheets toward the round member when in the first position (closed), but the first arm is positioned to bias the trailing edges of the sheets in a direction approximately parallel to the stacking surface when in the second position (open). Similarly, the second arm is positioned to bias the sheets toward the round member when in the third position (closed), but the second arm is positioned to not bias the trailing edges of the sheets toward or away from the round member to allow the sheets to lift off the round member when in the fourth position (open).

Additionally, a processor can be directly or indirectly connected to the first hinge and the second hinge. The processor is adapted to control the first hinge to only rotate the first arm to the second position (open) for a first type of sheet (e.g., lower beam strength sheets). However, the processor is adapted to control the second hinge to rotate the second arm to the fourth position (open) for both the first type of sheets and a second type of sheets (the first type of sheets have a lower beam strength relative to the second type of sheets). Further, a sensor can be directly or indirectly connected to the processor. The sensor detects whether the sheets are the first type of sheets or the second type of sheets. For example, the sensor (which can be, or include, multiple sensors of different types) can automatically detect the length of the media, the weight of the media, the humidity, temperature, and/or other environmental conditions within the stacking device, etc.

In greater detail, the first arm is rotatable around the first hinge to position the first arm in the first position (closed) when contacting the leading edges of both the first type of sheets and the second type of sheets. However, the first arm is rotatable around the first hinge to position the first arm in the second position (open) only when contacting the trailing edge of the first type of sheets; and the first arm does not rotate around the first hinge, but maintains the position of the first arm in the first position (closed), when contacting the trailing edge of the second type of sheets.

With respect to the second hinge, the second arm is rotatable around the second hinge to position the second arm in the third position (closed) when contacting the leading edges of both the first type of sheets and the second type of sheets. However, the second arm is rotatable around the second hinge to position the second arm in the fourth position (open) when contacting the trailing edges of both the first type of sheets and the second type of sheets.

Various sheet stacking methods herein include a number of steps, some of which include rotating the first arm around the first hinge to rotate the first arm between the first position (closed) and the second position (open). The first arm is positioned to bias sheets toward the round member when in the first position (closed). The first arm is positioned to not bias the sheets toward the round member when in the second position (open). The round member has leading edge receivers adapted to accept leading edges of the sheets, and the first arm is positioned to direct the leading edges of the sheets into the leading edge receivers of the round member when the first arm is in the first position (closed).

This processing also rotates the round member. The round member is positioned relative to the stacking surface to move the sheets toward the stacking surface when rotating. The process of controlling the first arm can control the hinge to position the arm to allow the trailing edge of a sheet to move from the round member in a direction approximately parallel to the stacking surface when the arm is in the second position (open).

In greater detail, in this processing, the first arm is rotated to the first position (closed) and the second arm is rotated to the third position (closed) when contacting the leading edges of both the first type of sheets and the second type of sheets. However, the arms operate differently on the trailing edges. Specifically, the first arm is rotated to the second position (open) only when contacting the trailing edge of the first type of sheets; and the first arm does not rotate, but maintains the first position (closed), when contacting the trailing edge of the second type of sheets. With respect to the second arm, in contrast the second arm rotates to the fourth position (open) when contacting the trailing edges of both the first type of sheets and the second type of sheets.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, when sheets are being inverted just prior to being stacked, if the sheets do not fully complete the flipping process, this can result in sheets being folded under other sheets or in sheets irregularly piling upon one another. The present inventors have found that different beam strength sheets will suffer from such problems differently.

More specifically, the present inventors have found that when longer length media, lighter weight media, and/or higher humidity condition are present, such conditions can reduce the relative beam strength of the sheets. These lower beam strength conditions can result in the trailing edge of the sheets not properly unfolding or uncurling, which may cause the trailing edge to not travel fully to the trailing end of the stacking surface, preventing the sheet from lying flat stacking surface. This can reduce the stack quality because some sheets may be folded under other sheets or other sheets may be irregularly piled upon one another. In contrast, with devices that produce high stack quality, all the sheets lie flat and the edges of such sheets are all aligned with one another.

In view of this, the devices and methods described herein use multiple arms, between which the sheets pass, to compensate for relatively low beam strength sheets. One of these arms (a first arm) is only rotated open for the trailing edges of sufficiently low beam strength sheets to help those sheets flip. Another of these arms (a second arm) rotates open for the trailing edges of both the lower and medium beam strength sheets. For sufficiently high beam strength sheets, neither arm may open when the trailing edges pass between the first and second arms. In contrast, to help direct the leading edges of sheets into a rotating disk that performs the flipping (inversion) process, both arms always remain closed for all leading edges of all sheet beam strengths.

FIGS. 1-5D illustrate examples of such sheet stacking apparatuses herein. As shown in FIGS. 1-5D, these devices include (among other components) what is generically referred to herein as a "frame" 110. The frame 110 can comprise many different components of the apparatus, which are elements of the apparatus and which are directly or indirectly connected to each other. Thus, the frame herein can include any or all of the various elements that physically support the enumerated components discussed below. In the attached drawings, identification numeral 110 is used to indicate the different items that can be considered this generically defined "frame." All the individual components discussed below are in a fixed location (even though many of the following components move, rotate, etc., in their fixed locations relative to the frame 110) and therefore all the following components are directly or indirectly connected to the frame 110 in some way.

Figure 1:
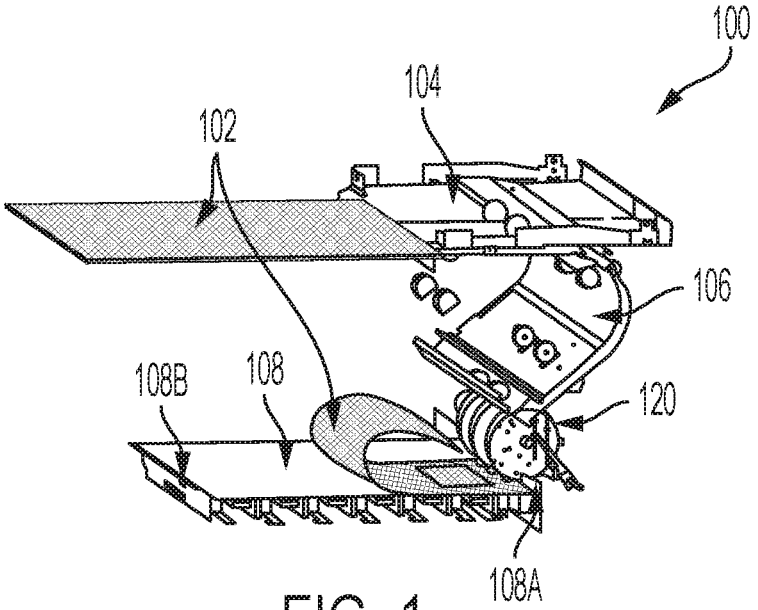
FIG. 1 is a schematic perspective view diagram illustrating stacking devices herein.

With greater specificity, FIG. 1 is a perspective view drawing that shows a stacking system 100 (apparatus, device, etc.) that includes a paper feeder device 104 that moves sheets 102 toward a curved paper guide 106. The paper feeder device 104 and/or the curved paper guide 106 can include elements that move and control the sheets 102 including, roller nips, belts (vacuum and/or friction), rollers, slides, alignment guides, sheet position sensors, etc. Such elements are known and are not discussed in detail to maintain reader focus on the salient elements herein.

As can be seen in FIG. 1, sheets 102 are moved by at least the paper feeder device 104 to the curved paper guide 106, which inverts the sheets 102 and directs the sheets 102 to a rotational device 120 which completes the sheet flipping (inversion). The rotational device 120 accepts the leading edges of the sheets 102, while spinning/rotating, to move the leading edges to the sheets 102 to leading end 108A of a stacking surface 108. The rotational device 120 does not accept the trailing edge of the sheet 102, but instead allows the trailing edges of the sheets 102 to unfold (uncurl, flip, etc.) and fall toward a trailing end 108B (opposite the leading end 108A) of the stacking surface. This operation inverts the sheet 102, relative to their position in the paper feeder device 104, and creates a stack of the sheets 102 on the stacking surface 108.

Figure 2A:
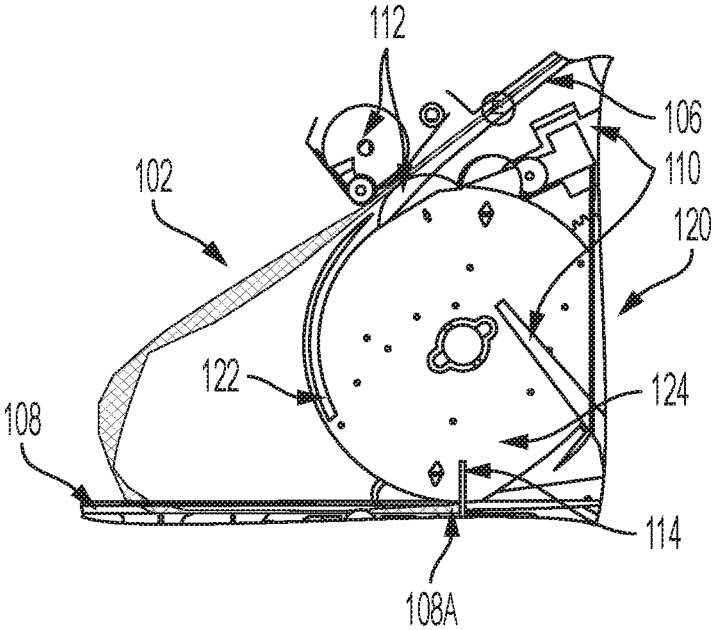
FIGS. 2A-6B are schematic cross-sectional view diagrams illustrating the stacking devices shown in FIG. 1 herein.

FIG. 2A is a cross sectional drawing showing a portion of the stacking system 100 in greater detail. Specifically, FIG. 2A shows that the rotational device 120 includes one or more disks 124. The disk 124 is a round mechanical component that rotates and that can be hollow or solid, thin or thick, etc., with a rounded exterior; and, therefore can take the form of a cylinder, flat disk or wheel (thin or thick), etc. Multiple disks can be center-connected to a common axel which can be rotated by a motor or other device to rotate all disks 124 synchronously together. FIG. 2A also illustrates a pair of nip rollers 112, one or more of which can rotate to drive the sheets 102 along the curved paper guide 106.

As shown in FIG. 2A, the disk 124 can include slots, cavities, openings, etc., that are referred to generically as "leading edge receivers" 122, and that are configured and shaped to receive the leading edges of sheets of media. As the rotational device 120 continuously rotates, the leading edge of the sheets 102 runs into the planar surface of a notched alignment structure 114 that is connected to the leading end 108A of the stacking surface 108. As shown in FIG. 1, the notched alignment structure 114 has notches that allow only the disks 124 to pass through the notched alignment structure 114; however, the leading edges of the sheets 102 contact the remaining non-notched planar surface of the notched alignment structure 114, stopping the sheets 102 on the stacking surface 108 and aligning the leading edges of the stacked sheets 102 along the planar surface of the notched alignment structure 114. When the leading edge of the sheets 102 runs into the notched alignment structure 114, this stops movement of the sheets 102 on the stacking surface 108 and pulls the sheets 102 from the leading edge receiver 122. Note that while the drawings illustrate that the disks 124 have two leading edge receivers 122, more or less leading edge receivers 122 could be included in each disk 124.

Figure 2B:
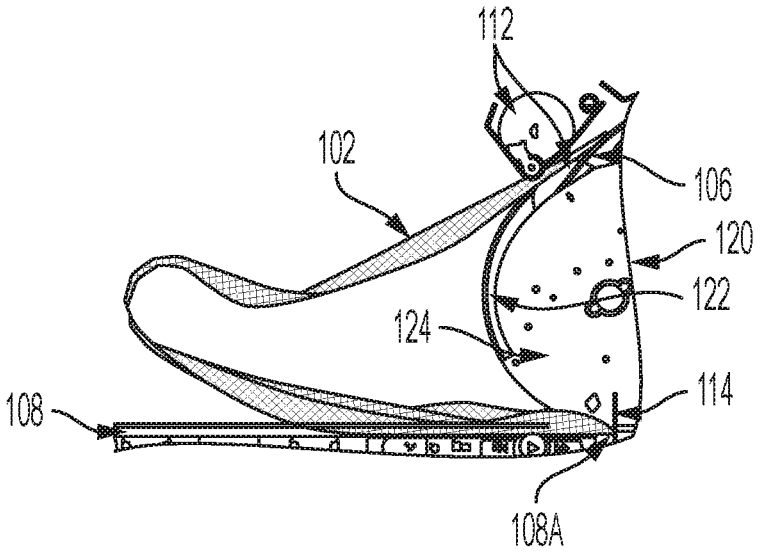

While the structure shown in FIGS. 1-2A generally works very well with most media types, when longer length media, lighter weight media, and/or higher humidity condition are present and such reduces the relative beam strength of the sheets 102, the trailing edge of the sheets 102 may not properly unfold or uncurl and may not travel fully to the trailing end 108B of the stacking surface 108, preventing the sheet 102 from lying flat stacking surface 108. This is shown, for example, in FIG. 2B where the sheet 102 is shown with a slight buckle (e.g., fold, S-shape, opposing alternating curve shapes (opposing arch shapes), etc.) when compared to the mostly uniform single continuous curved arch shape of the sheet 102 shown in FIG. 2A.

If the sheet 102 shown in FIG. 2B does not fully unfold, the next sheet 102 will not have a flat surface upon which to lie, causing the next sheet 102 to also fold (or at least not lie flat) and the same can continue with the following sheets, eventually resulting in an irregular stack of sheets or a jam of multiple sheets irregularly piled together.

Figure 2C:
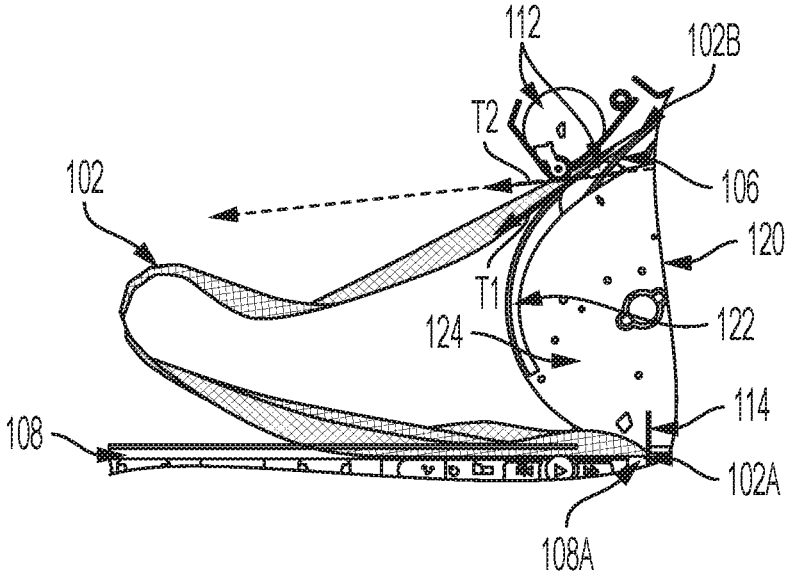

As shown in FIG. 2C, the structures and methods herein address this issue. More specifically, the present inventors discovered that the sheet 102 will undesirably buckle if the trailing edge 102B of relatively low beam strength sheets continues to travel along trajectory (direction) T1 because this trajectory T1 forces/drives the trailing edge 102B of the sheet 102 downward and more toward the stacking surface 108, promoting the undesirable buckle shown in FIGS. 2B-2C. In contrast, the present inventors discovered that if the trailing edge 102B of the sheet 102 can be directed to travel in a trajectory T2 that is relatively more parallel to the stacking surface 108 (relative to trajectory T1) the undesirable buckle can be avoided for relatively low beam strength sheets.

Figure 3A:
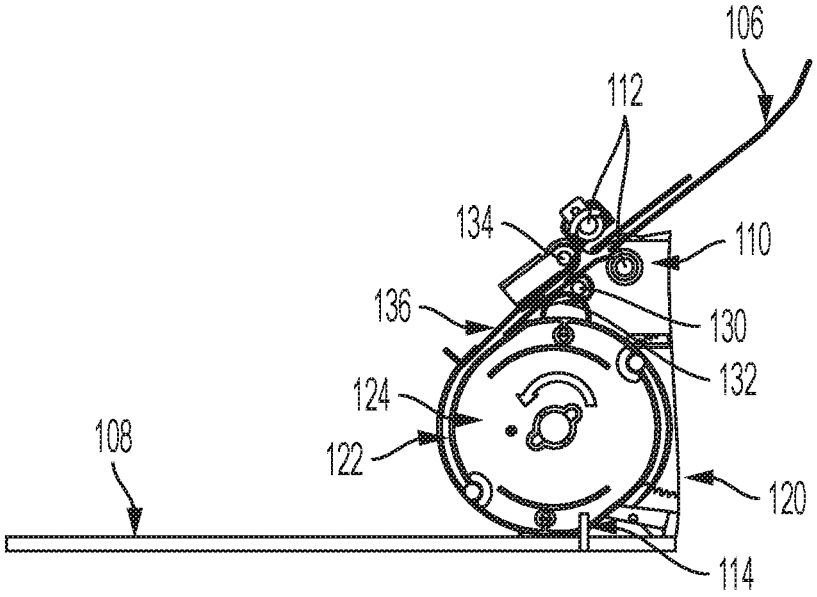

The exemplary structures illustrated in the drawings cause the trailing edge 102B of the sheet 102 to travel in the trajectory T2 that is relatively more parallel to the stacking surface 108 (e.g., relative to trajectory T1). For example, FIG. 3A is a partial and more detailed view of the structure shown in FIGS. 1-2C and includes a first arm 132 and a second arm 136, a first hinge 130 directly or indirectly connecting the first arm 132 to the frame 110, and a second hinge 134 directly or indirectly connecting the second arm 136 to the frame 110. FIGS. 3B-5B show how the structure shown in FIG. 3A operates with different sheet beam strengths to direct the trailing edge 102B of the sheet 102 to travel in the trajectory T2 that is relatively more parallel to the stacking surface 108 (e.g., by opening a first arm 132 as shown in FIG. 4A and discussed below).

These "arms" 132, 136 can be paddles, baffles, guides, bars, projections, etc., and have the ability to maintain or change the trajectory of the sheets 102. The first arm 132 is rotatable around the first hinge 130 to rotate the first arm 132 between a first position (closed, FIG. 3B) and a second position (open, FIG. 5A, discussed below). The second arm 136 is similarly rotatable around the second hinge 134 to rotate the second arm 136 between a third position (closed, FIG. 3B) and a fourth position (open, FIG. 4A, discussed below). The second arm 136 can be longer than the first arm 132 and can extend closer to the stacking surface 108 than the first arm 132 when the first arm 132 is in the first position (closed) and the second arm 136 is in the third position (closed). The sheets 102 pass between the first arm 132 and the second arm 136.

Figure 3B:
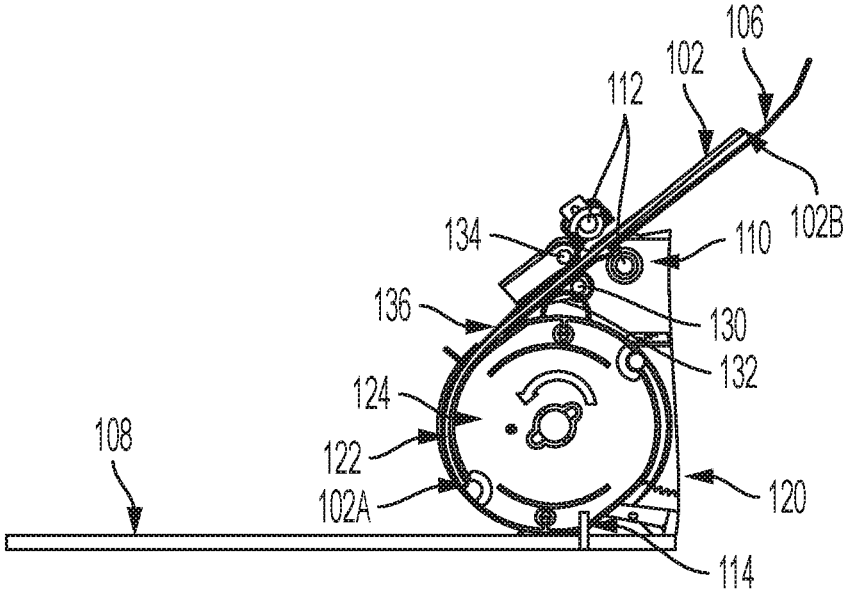
Figure 4A:
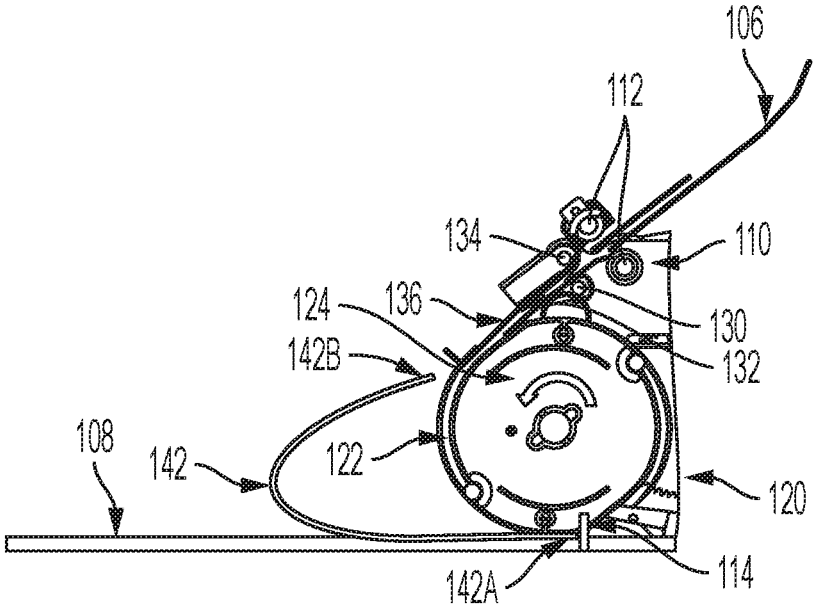

FIG. 3B shows the same structure shown in FIG. 3A with a generic sheet 102 that has been fed into one of the leading edge receivers 122 of the round member 124. As can be seen in FIG. 3B, the sheets 102 pass between the first arm 132 and the second arm 136 when moving from the curved paper guide 106, past the first and second arms 132, 136, to the stacking surface 108.

In FIG. 3B the leading edge 102A of the sheet 102 is shown within the leading edge receiver 122. Additionally, FIG. 3B shows that the first arm 132 is in the first position (closed) and the second arm 136 is in the third position (closed). Therefore, when the first and second arms 132, 136 are closed they are positioned to direct the leading edge 102A of the sheet 102 into the leading edge receivers 122 of the round member 124 (and this is the machine state maintained for all leading edges of all sheets).

Figure 4B:
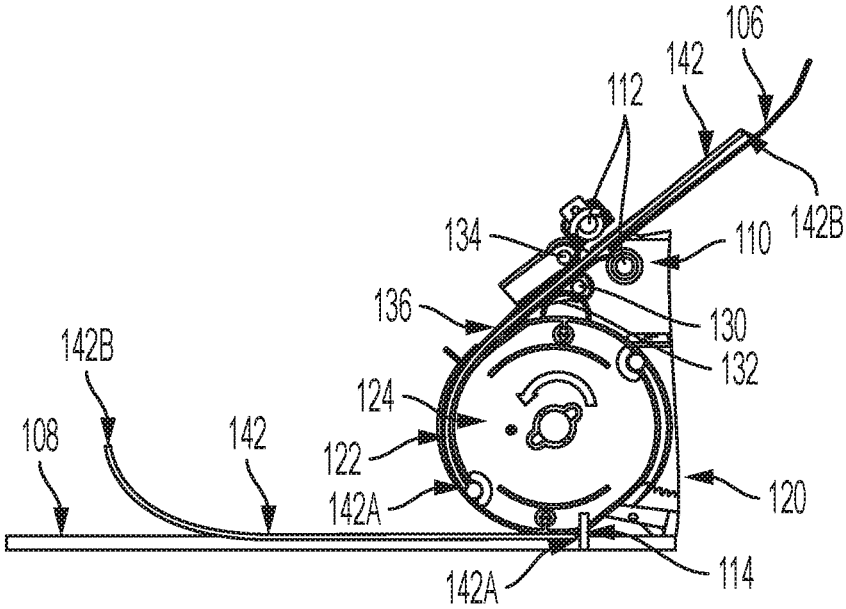

As noted above, these structures generally work very well with most media types. However, when longer length media, lighter weight media, and/or higher humidity condition are present and such factors reduce the relative beam strength of the sheets, the trailing edge of the sheets may not properly unfold or uncurl, preventing the sheets from lying flat. In order to illustrate these situations and the unique way in which the structures and methods herein address these issues, FIGS. 4A-4B illustrate a sheet 142 having a relatively higher beam strength, FIGS. 5A-5B illustrate a sheet 144 having a relatively medium beam strength, and FIGS. 6A-6B illustrate a sheet 146 having a relatively lower beam strength (where medium beam strength is between high and low beam strengths).

Figure 5A:
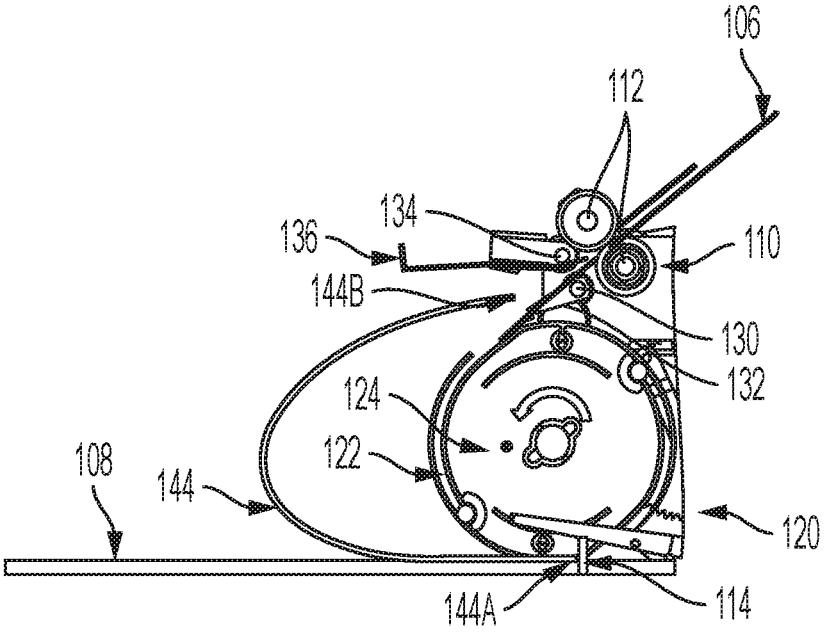
Figure 5B:
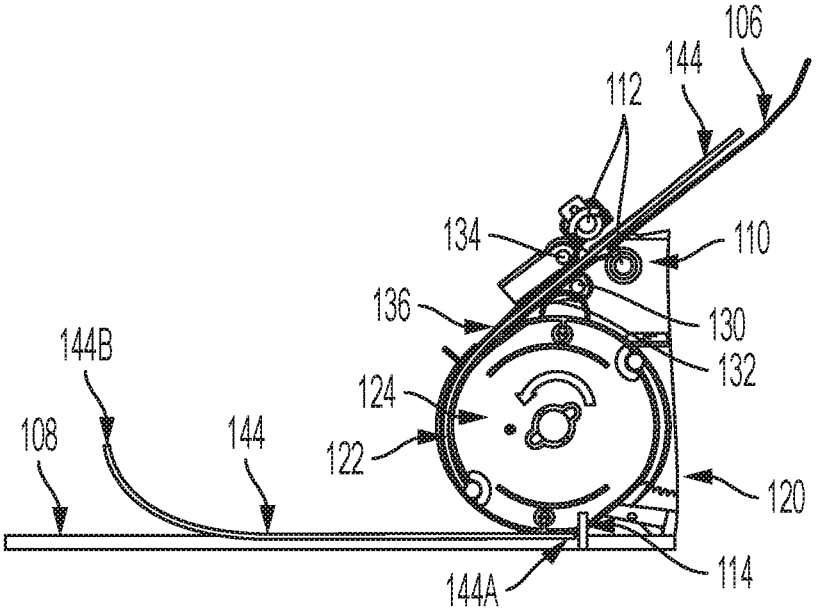
Figure 6A:
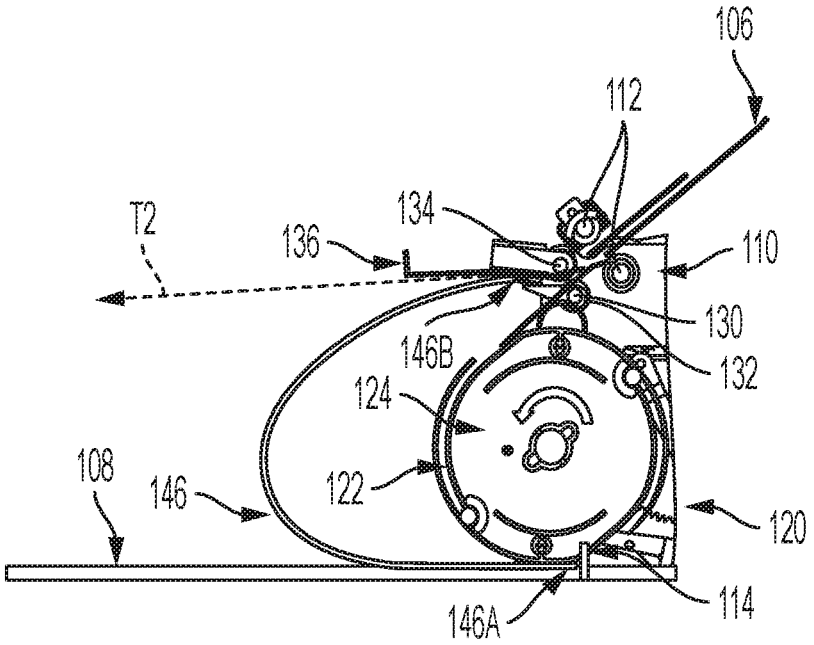
Figure 6B:
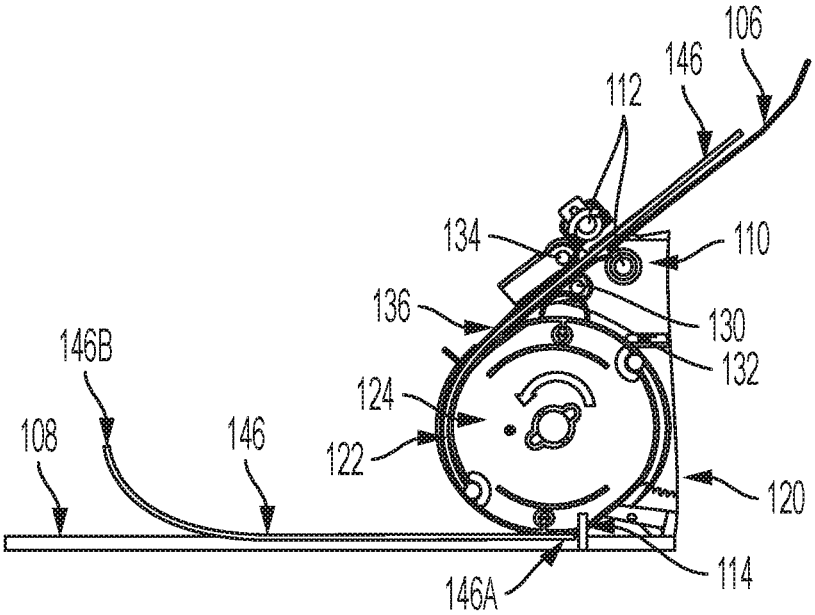

More specifically, FIGS. 4A, 5A, and 6A illustrate the processing state where the trailing edges 142B, 144B, and 146B of the sheets 142, 144, and 146 have just lost contact with the round member 124. FIGS. 4B, 5B, and 6B illustrate the processing state where the next sequential sheet has been fed into the leading edge receiver 122 of the round member 124 and where the trailing edges 142B, 144B, and 146B of the sheets 142, 144, and 146 have almost fully (or fully) uncurled to lie flat on the stacking surface 108 or lie flat on top of other sheets that are on the stacking surface 108.

In the realm of sheets, beam strength is known to mean, for example, the tendency for an unsupported sheet to maintain, or return to, a flat state. For purposes herein, beam strength is considered a sheet's own unsupported, unaided ability to unfold (uncurl) when released from a curved surface so as to return to a flat state on its own and without manipulation by external components. Higher beam strengths correspond to a greater ability to self-unfold or self-uncurl, while lower beam strengths correspond to the opposite. The beam strength will vary depending upon the weight (e.g., $g/cm^2$), stiffness, length, etc., of the sheets, as well as the environmental conditions (humidity, temperature, etc.). Therefore, the very same sheet (same type, weight, length, etc.) may have a higher beam strength in one environment (e.g., lower humidity) and a lower beam strength in a different environment (e.g., higher humidity).

The distinction between a relatively lower beam strength sheet and a relatively higher beam strength sheet varies based upon the different environmental conditions, sheet conditions, machine conditions, user definition of stack quality, etc. Therefore, no absolute measures of beam strengths are presented here. Instead, broadly a relatively higher beam strength is higher than a relatively lower beam strength, with a medium beam strength being between the two.

Additionally, the relatively lower beam strength will, for a given machine and a given environment, produce stacking errors that are above a "stack quality standard" that may be established by an operator or may be industry standards. Therefore, when sheets of a specific brand, type, length, weight, etc., used in a specific stacking machine that is subjected to specific environmental conditions (e.g., humidity, temperature, etc.) results in stacking errors that are below a user's subjective expected "stack quality" standard, such sheets can be classified as relatively lower beam strength sheets. Correspondingly, sheets that do not result in such stacking errors or where the stack quality is above the minimum quality standard, under the same conditions, environment, machine, etc., are classified as relatively higher beam strength sheets. The classification of different lengths, weights, types, brands, etc., of sheets (for different environmental conditions) can be found empirically for each specific machine/environment or potentially from industry-standard records if such are established.

As shown in FIG. 3A, the first arm 132 is rotatable around the first hinge 130 and the second arm 136 is rotatable around the second hinge 134 to position both the first arm 132 and the second arm 136 in the closed position (first and third positions, respectively) when contacting the leading edges of all types of beam strength sheets (high, low, and medium beam strength sheets, all of which are represented generically in FIG. 3A using the identification number 102). This positioning helps guide all leading edges 102A of all sheets 102 into the leading edge receiver 122 of the round member 124. However, different positions are utilized for the first and second arms 132, 136 for the trailing edges of sheets that have different beam strengths, as shown in the following examples illustrated in FIGS. 4A-6B.

In a first example for relatively higher beam strength sheets 142, shown in FIG. 4A, the first and second arms 132, 136 are both left in the closed position (first and third positions, respectively) when the trailing edge 142B of the higher beam strength sheets 142 passes between the first and second arms 132, 136. At this processing state shown in FIG. 4A, the leading edge of the sheet 142A has already become firmly positioned against the notched alignment structure 114, preventing the sheet 142 from sliding along, or moving horizontally relative to, the stacking surface 108.

Maintaining the first and second arms 132, 136 in the closed position as the trailing edge 142B passes between the first and second arms 132, 136 causes the trailing edge 142B to be released from the surface of the disk 124 only after the trailing edge 142B passes by the distal end of the longer second arm 136 (the distal end of the second arm 136 is the end furthest away from the second hinge 134). However, this does not result in decreased stack quality because the relatively higher beam strength sheets 142 will have a relatively higher ability/tendency to return to a flat position (e.g., snap back to a flat position) and there is, therefore, no need to rotate either the first arm 132 or the second arm 136 to the open position for such higher beam strength sheets 142. Allowing the first and second arms 132, 136 to remain in the closed position for both the leading edge 142A and the trailing edge 142B of the higher beam strength sheets 142 reduces wear on the components and reduces energy consumption (energy is used to rotate the arms).

FIG. 4B illustrates the processing state where the next sequential relatively higher beam strength sheet 142 has been fed into the leading edge receiver 122 of the round member 124 and where the trailing edge 142B of the previous sheet 142 has almost fully (or fully) uncurled to lie flat on the stacking surface 108 or lie flat on top of other sheets that are on the stacking surface 108. Note that both the first and second arms 132, 136 are in the closed position as the leading edge 142A passes between the first and second arms 132, 136 in FIG. 4B.

In a second example for relatively medium beam strength sheets 144 (relatively lower beam strength than sheets 142), shown in FIG. 5A, the first arm 132 is left in the closed position (first position) but the second arm 136 is rotated around the second hinge 134 to the open position (fourth position) when the trailing edge 144B of the medium beam strength sheets 144 passes between the first and second arms 132, 136 to not apply any bias to the sheets. At this processing state shown in FIG. 5A, again the leading edge of the sheet 144A has already become firmly positioned against the notched alignment structure 114, preventing the sheet 144 from sliding along, or moving horizontally relative to, the stacking surface 108.

Maintaining the first arm 132 in the closed position, but the second arm 136 in the open position, as the trailing edge 144B passes between the first and second arms 132, 136 causes the trailing edge 144B to be released from the region of the roller nips 112 after the trailing edge 144B passes by the proximal end of the longer second arm 136 (the proximal end of the second arm 136 is the end closest to the second hinge 134) allowing the trailing edge 144B to move away from the disk 124. Note that in FIG. 5A, the medium beam strength sheet 144 separates from the region of the roller nips 112 a distance further away from the stacking surface 108 relative to when the higher beam strength sheet 142 separates from the surface of the disk 124 in FIG. 4A, creating a broader arc in the sheet 144 in FIG. 5A, relative to more narrow arc of the sheet 142 shown in FIG. 4A. This broader arc helps prevent the relatively medium beam strength sheet 144 sheet from the folding shown in FIG. 2B, thereby maintaining high stack quality even for medium beam strength sheets 144.

The processing state shown in FIG. 5A therefore does not result in decreased stack quality because the medium beam strength sheets 144 will have a relatively medium ability/tendency to return to a flat position (e.g., snap back to a flat position) and there is, therefore, no need to rotate both the first arm 132 and the second arm 136 to the open position for such medium beam strength sheets 144 because only rotating the second arm 136 to the open position is sufficient for medium beam strength sheets 144. Allowing the first arm 132 to remain in the closed position for both the leading edge 144A and the trailing edge 144B of the medium beam strength sheets 144 reduces wear on the components of the first arm 132 and reduces energy consumption; however, rotating the second arm 136 to the open position for medium beam strength sheets 144 prevents irregular stacking and stacking jams, thereby maintaining the user-established stack quality.

Again, FIG. 5B again illustrates the processing state where the next sequential relatively medium beam strength sheet 144 has been fed into the leading edge receiver 122 of the round member 124 and where the trailing edge 144B of the previous sheet 144 has almost fully (or fully) uncurled to lie flat on the stacking surface 108 or lie flat on top of other sheets that are on the stacking surface 108. As shown in FIG. 5B, the second arm 134 has been rotated back to the closed position for the next sheet so that both the first and second arms 132, 136 are in the closed position as the leading edge 144A of the next sheet 144 passes between the first and second arms 132, 136 to ensure the leading edge 146A is fed into the leading edge receiver 122 of the round member 124.

In a third example for relatively lower beam strength sheets 146 (relatively lower beam strength than sheets 144) shown in FIG. 6A, the first and second arms 132, 136 are both rotated to the open position (second and fourth positions, respectively) when the trailing edge 146B of the lower beam strength sheets 146 passes between the first and second arms 132, 136. At this processing state shown in FIG. 6A, the leading edge of the sheet 146A has already become firmly positioned against the notched alignment structure 114, preventing the sheet 146 from sliding along, or moving horizontally relative to, the stacking surface 108.

Rotating the first and second arms 132, 136 to the open position as the trailing edge 146B passes between the first and second arms 132, 136 causes the trailing edge 146B to be released from the region of the roller nips 112 after the trailing edge 144B passes by the proximal end of the longer second arm 136 and to be pushed (redirected) away from the disk 124 by the first arm 132 in a trajectory (e.g., T2) that is approximately (e.g., within 20% of) parallel to, or at least relatively more parallel to, the stacking surface 108.

Movement of the trailing edge 146B in trajectory T2 is not hindered by the second arm 136 because it also is in the open position. Because the trailing edge 146B is pushed away from the surface of the disk 124 by the first arm 132, there is no decrease in stack quality even for relatively lower beam strength sheets 146. More specifically, the force imparted by the open first arm 132 to the trailing edge 146B is in a direction more parallel to the stacking surface 108 (e.g., horizontal direction) relative to the processing states shown in FIGS. 4A-5B (which allow the trailing edges 142B, 144B to move in a direction more perpendicular to the stacking surface 108 (e.g., more in a downward direction). This redirection of the trailing edge 146B by the first arm 132 creates an even broader arc in the sheet 146 in FIG. 6A, relative to more narrow arcs of the sheets 142 and 144 shown in FIGS. 4A and 5A, respectively. This broader arc helps prevent the relatively lower beam strength sheet 146 from the folding shown in FIG. 2B.

Again, FIG. 6B illustrates the processing state where the next sequential relatively lower beam strength sheet 146 has been fed into the leading edge receiver 122 of the round member 124 and where the trailing edge 146B of the previous sheet 146 has almost fully (or fully) uncurled to lie flat on the stacking surface 108 or lie flat on top of other sheets that are on the stacking surface 108. Note that both the first and second arms 132, 136 are rotated back to the closed position as the leading edge 146A passes between the first and second arms 132, 136 in FIG. 6B to ensure the leading edge 146A is fed into the leading edge receiver 122 of the round member 124.

Therefore, the structures and methods herein address the issue of trailing edges of low beam strength sheets 146 not properly unfolding or uncurling by selectively opening the first and second arms 132, 136. Specifically, for sufficiently low beam strength sheets, not only does the second arm 136 open to allow the inherent uncurling/unfolding ability of the sheet 146 to move the trailing edge of the low beam strength sheet away from the round member 124, the first arm 132 additionally pushes the trailing edge 146B of the low beam strength sheet 146 away from the round member 124 in a trajectory approximately perpendicular to the stacking surface 108. Thus, the force imparted by the open first arm 132 is in the direction relatively more parallel to the stacking surface 108. In this way, the open first arm 132 provides additional force to the sheet's own uncurling and unfolding ability to combat the tendency of such low beam strength sheets 146 to fold or buckle, thereby maintaining high stack quality.

Figure 7:
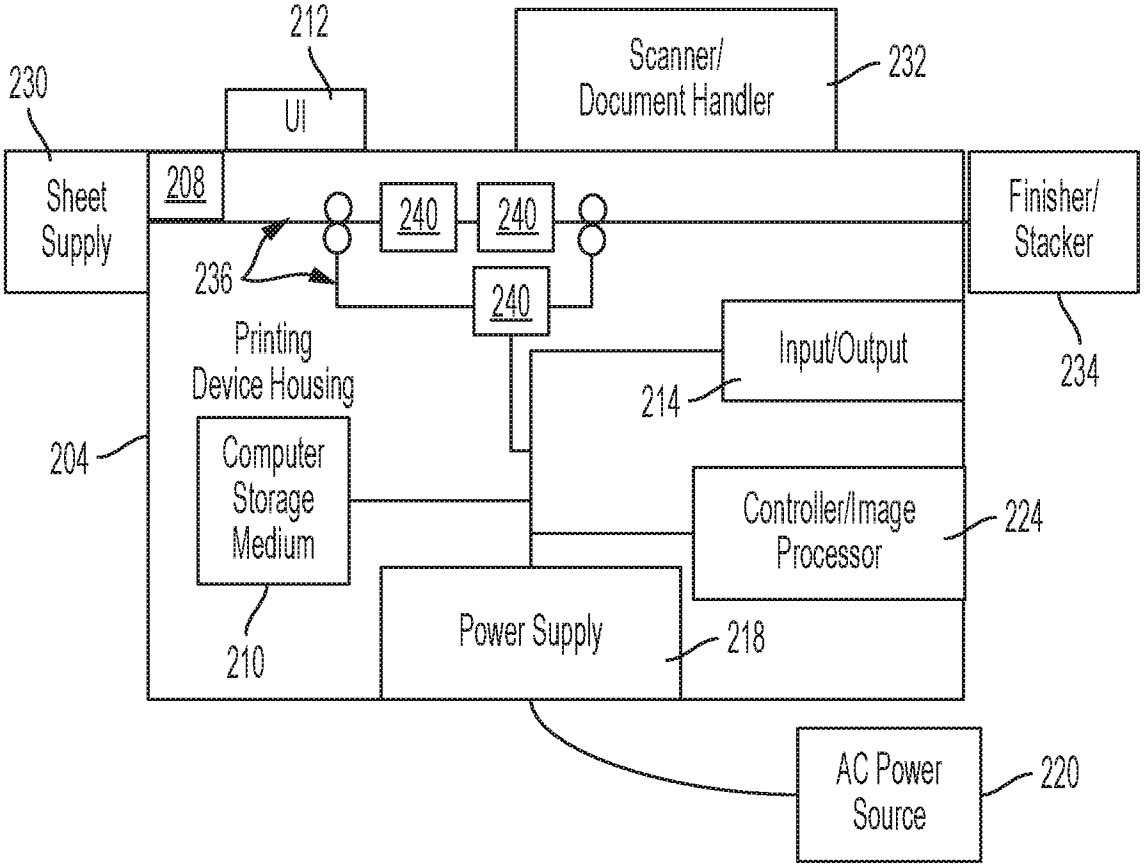
FIG. 7 is a schematic diagram of a printing device that uses the stacking devices shown in FIG. 1.

FIG. 7 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a user interface (UI) assembly 212. The user may receive messages, instructions, and menu options from, and enter instructions through, the user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 7, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher/stacker 234 which can fold, staple, sort, etc., the various printed sheets. The stacking system 100 discussed above can be included internally within the printing device 204 at any location where sheet stacking is needed, or externally as part of, for example, the finisher/stacker 234. Also, the printing device 204 can include at least one accessory functional component (such as a scanner/document handler 232 (automatic document feeder (ADF)), etc.) that also operate on the power supplied from the external power source 220 (through the power supply 218).

The processor 224 can be directly or indirectly connected to, and can automatically control, the paper feeder device 104, the nip rollers 112, rotational device 120, etc. Additionally, the processor 224 can be directly or indirectly connected to, and can automatically control, the first hinge 130 and the second hinge 134 so that the processor 224 can control the rotation of the first arm 132 and the second arm 136.

More specifically, the processor 224 is adapted to control the first hinge 130 to only rotate the first arm 132 to the second position (open) for trailing edges of low beam strength sheets 146. However, the processor 224 is adapted to control the second hinge 134 to rotate the second arm 136 to the fourth position (open) for both the first type of sheets 146 and a second type of sheets 142 or 144 to not apply any bias to such sheets (again, the first type of sheets 146 have a lower beam strength relative to the second type of sheets 142 or 144).

Further, as shown in FIG. 7, a sensor 208 can be directly or indirectly connected to the processor 224. The sensor 208 can automatically detect whether the sheets 102 are the first type of sheets 146 or the second type of sheets 142, 144 (or such information can be manually entered through the user interface 212). For example, the sensor 208 (which can be, or include, multiple sensors of different types) can automatically detect the length of the media (media length sensor(s)), the weight of the media (media thickness/weight per area sensor), the humidity (hygrometer), temperature (thermometer), and/or other environmental conditions within the stacking device, etc.

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

Figure 8:
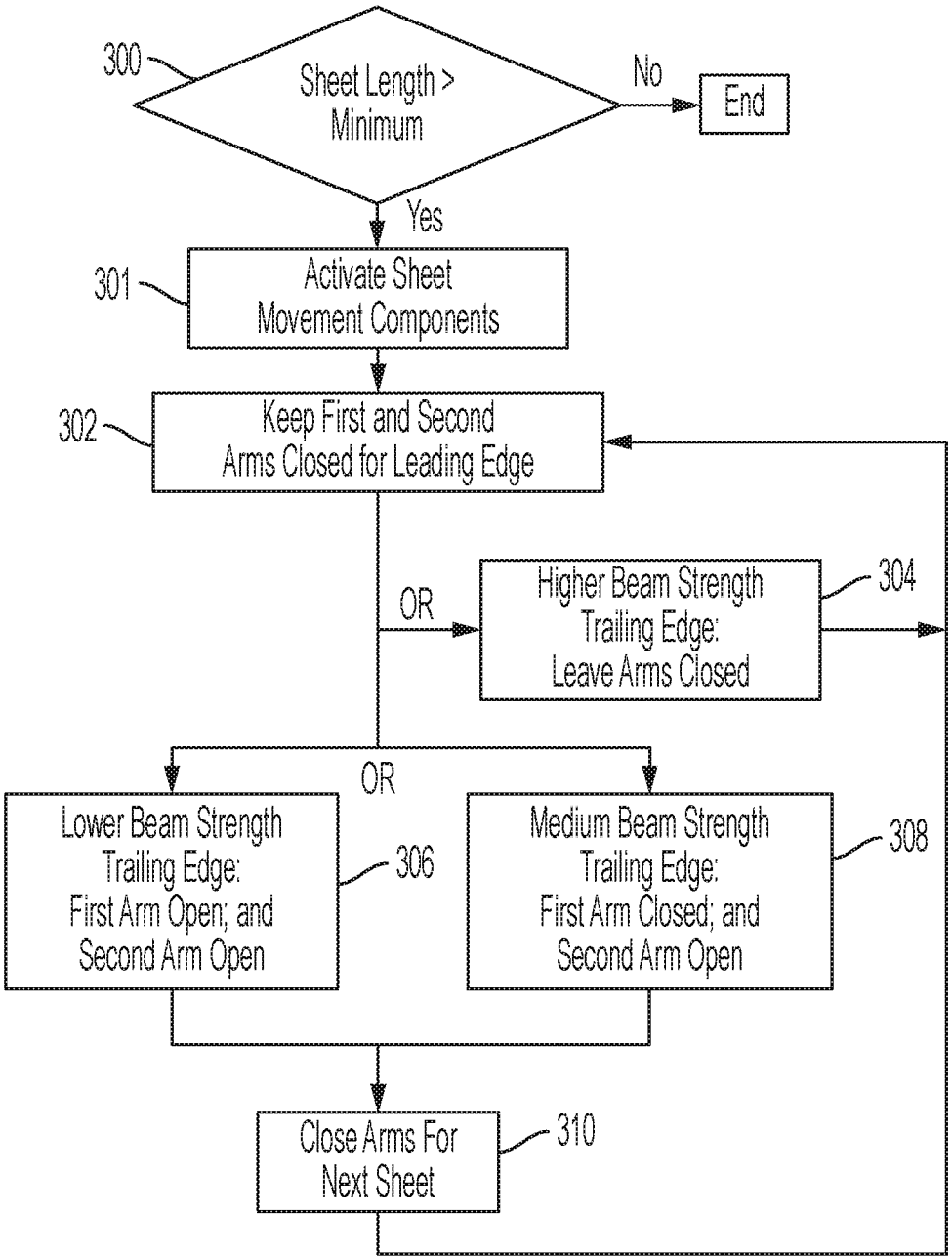
FIG. 8 is a flowchart showing processing herein.

FIG. 8 is flowchart illustrating exemplary methods herein. The processing described herein may, in some situations, be more useful for longer sheets; and, therefore, sometimes the processing herein may not be performed for smaller sheets. This is reflected in item 300 in FIG. 8 where the sheets length is compared to an established minimum sheet length and the following processing only occurs for sheets that exceed the previously established minimum sheet length.

When performed, this processing activates sheet movement components (e.g., the paper feeder device, the nip rollers, rotational device, etc.) in item 301. The round member is positioned relative to the stacking surface to move the sheets toward the stacking surface when rotating in item 301. Specifically, these methods rotate the first arm around the first hinge to rotate the first arm between the first position (closed) and the second position (open). The first arm is positioned to bias sheets toward the round member when in the first position (closed). The first arm is positioned to not bias the sheets toward the round member when in the second position (open). The round member has leading edge receivers adapted to accept leading edges of the sheets, and the first arm is positioned to direct the leading edges of the sheets into the leading edge receivers of the round member when the first arm is in the first position (closed). The process of controlling the first arm can control the hinge to position the arm to allow the trailing edge of a sheet to move from the round member in a direction approximately parallel to the stacking surface when the arm is in the second position (open).

Therefore, as shown in item 302 in FIG. 8, in this processing, the first and second arms are kept closed when contacting the leading edges of both the first type of sheets and the second type of sheets. However, the arms operate differently on the trailing edges.

Specifically, as shown in item 304, for the trailing edge of sufficiently high beam strength (higher beam strength) sheets, this processing leaves both arms closed and processing returns to item 302 to await the leading edge of the next sheet. Alternatively, in item 306, for the trailing edge of sufficiently low beam strength (lower beam strength) sheets, this processing rotates both arms to the open position. In another alternative, in item 308, for the trailing edge of beam strength sheets that are between the higher and lower beam strengths (medium beam strength) this processing leaves the first arm closed, but rotates the second arm to the open position.

While item 304 immediately returns to processing the leading edge of the next sheet, because items 306 and 308 have rotated at least one arm to the open position, in item 310 this processing closes any open arms for the next sheet and returns processing to item 302.

Therefore, with the methods herein, the first arm is rotated to the second position (open) only when contacting the trailing edge of the lower beam strength sheets (first type of sheets) as shown in item 306; and the first arm does not rotate, but maintains the first position (closed), when contacting the trailing edge of the second type of sheets (medium and high beam strengths) as shown in items 304 and 308. With respect to the second arm, the second arm rotates to the fourth position (open) when contacting the trailing edges of both the first type of sheets 306 and the second type of sheets 308 and may only remain closed when contacting the highest beam strength sheets in item 304.

Herein, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A sheet stacking apparatus comprising:

a frame;

a round member directly or indirectly connected to the frame;

an arm directly or indirectly connected to the frame; and a processor directly or indirectly connected to the arm wherein the arm is rotatable between a first position and a second position, wherein the arm is adapted to be positioned to bias a second type of sheets toward the round member when in the first position, wherein the arm is adapted to be positioned to bias a first type of sheets away from the round member when in the second position, and wherein the processor is adapted to position the arm in the second position for a trailing edge of the first type of sheets and to position the arm in the first position for a trailing edge of the second type of sheets.

2. The apparatus according to claim 1, wherein the first type of sheets have a lower beam strength relative to the second type of sheets.

3. The apparatus according to claim 1, further comprising a sensor directly or indirectly connected to the processor, wherein the sensor identifies sheets as being the first type of sheets or the second type of sheets.

4. The apparatus according to claim 1, wherein the arm is controllable to position the arm in the first position when contacting a leading edge of the first type of sheets and the second type of sheets and in the second position when contacting a trailing edge of the first type of sheets.

5. The apparatus according to claim 1, further comprising a stacking surface directly or indirectly connected to the frame, wherein the round member is adapted to rotate, wherein the round member is positioned relative to the stacking surface to move the first type of sheets and the second type of sheets in a first trajectory toward the stacking surface when rotating, and wherein the arm redirects a trailing edge of the first type of sheets to move in a second trajectory, that is more parallel to the stacking surface relative to the first trajectory, when the arm is in the second position.

6. The apparatus according to claim 1, wherein the round member comprises leading edge receivers adapted to accept a leading edge of the first type of sheets and the second type of sheets, and wherein the arm is positioned to direct the leading edge of the first type of sheets and the second type of sheets into the leading edge receivers of the round member when the arm is in the first position.

7. A sheet stacking apparatus comprising:

a frame;

a round member directly or indirectly connected to the frame;

a first arm directly or indirectly connected to the frame;

a second arm directly or indirectly connected to the frame; and a processor directly or indirectly connected to the first arm and the second arm wherein the first arm is rotatable between a first position and a second position, wherein the second arm is rotatable between a third position and a fourth position, wherein the first arm is adapted to be positioned to bias a second type of sheets toward the round member when in the first position, wherein the first arm is adapted to be positioned to bias a first type of sheets away from the round member when in the second position, wherein the second arm is positioned to bias the first type of sheets and the second type of sheets toward the round member when in the third position, wherein the second arm is positioned to not bias the first type of sheets when in the fourth position, and wherein the processor is adapted to:

position the first arm in the second position for a trailing edge of the first type of sheets;

position the first arm in the first position for a trailing edge of the second type of sheets; and position the second arm in the fourth position for the trailing edge of the first type of sheets and the trailing edge of the second type of sheets.

8. The apparatus according to claim 7, wherein the first type of sheets have a lower beam strength relative to the second type of sheets.

9. The apparatus according to claim 7, further comprising a sensor directly or indirectly connected to the processor, wherein the sensor identifies sheets as being the first type of sheets or the second type of sheets.

10. The apparatus according to claim 7, wherein the first arm and the second arm are controllable to position the first arm in the first position when contacting a leading edge of the first type of sheets and the second type of sheets and position the second arm in the third position when contacting the leading edge of the first type of sheets and the second type of sheets.

11. The apparatus according to claim 7, further comprising a stacking surface directly or indirectly connected to the frame, wherein the round member is adapted to rotate, wherein the round member is positioned relative to the stacking surface to move the first type of sheets and the second type of sheets in a first trajectory toward the stacking surface when rotating, and wherein the first arm redirects a trailing edge of the first type of sheets to move in a second trajectory, that is more parallel to the stacking surface relative to the first trajectory, when the first arm is in the second position.

12. The apparatus according to claim 7, wherein the round member comprises leading edge receivers adapted to accept a leading edge of the first type of sheets and the second type of sheets, and wherein the first arm positionable in the first position for the leading edge of the first type of sheets and the second type of sheets and the second arm is positionable in the third position for the leading edge of the first type of sheets and the second type of sheets to direct the leading edge of the first type of sheets and the second type of sheets into the leading edge receivers of the round member.

13. A sheet stacking method comprising:

rotating a round member to move sheets to a stacking surface; and rotating an arm to rotate the arm between a first position and a second position relative to the round member, wherein the arm is adapted to be positioned to bias a second type of sheets toward the round member when in the first position, wherein the arm is adapted to be positioned to bias a first type of sheets away from the round member when in the second position, and wherein the rotating of the arm controls the arm to only rotate to the second position for the first type of sheets and to maintain the arm in the first position for the second type of sheets.

14. The method according to claim 13, wherein the first type of sheets have a lower beam strength relative to the second type of sheets.

15. The method according to claim 13, further comprising detecting whether sheets are the first type of sheets using a sensor.

16. The method according to claim 13, wherein the rotating of the arm controls the arm to positions the arm in the first position when contacting a leading edge of the first type of sheets and the second type of sheets and in the second position when contacting a trailing edge of the first type of sheets.

17. The method according to claim 13, wherein the round member is positioned relative to the stacking surface to move the first type of sheets and the second type of sheets in a first trajectory toward the stacking surface when rotating, and wherein the arm redirects a trailing edge of the first type of sheets to move in a second trajectory, that is more parallel to the stacking surface relative to the first trajectory, when the arm is in the second position.

* * * * *